US011224909B2

(12) United States Patent
Nishijima et al.

(10) Patent No.: US 11,224,909 B2
(45) Date of Patent: Jan. 18, 2022

(54) PROTRUSION MOLDING DEVICE, PROTRUSION MOLDING METHOD, AND MOLDED ARTICLE

(71) Applicant: NIPPON STEEL CORPORATION, Tokyo (JP)

(72) Inventors: Shinnosuke Nishijima, Tokyo (JP); Kouki Tomimura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 331 days.

(21) Appl. No.: 15/742,742

(22) PCT Filed: Jun. 29, 2016

(86) PCT No.: PCT/JP2016/069332
§ 371 (c)(1),
(2) Date: Jan. 8, 2018

(87) PCT Pub. No.: WO2017/006830
PCT Pub. Date: Jan. 12, 2017

(65) Prior Publication Data

US 2018/0200773 A1 Jul. 19, 2018

(30) Foreign Application Priority Data

Jul. 7, 2015 (JP) ..... JP2015-135834
Jun. 23, 2016 (JP) ..... JP2016-124835

(51) Int. Cl.
*B21D 28/34* (2006.01)
*B21D 22/02* (2006.01)
(Continued)

(52) U.S. Cl.
CPC ..... *B21D 28/343* (2013.01); *B21D 22/02* (2013.01); *B21D 28/16* (2013.01); *B21D 28/26* (2013.01);
(Continued)

(58) Field of Classification Search
CPC ..... B21D 22/02; B21D 22/04; B21D 22/06; B21D 22/10; B21D 22/20; B21D 22/22;
(Continued)

(56) References Cited

U.S. PATENT DOCUMENTS 1,040,567 A * 10/1912 Newell ..... B21D 31/02 72/327
2,369,896 A * 2/1945 Harris ..... B21D 28/34 83/685
(Continued)

FOREIGN PATENT DOCUMENTS

DE 19613180 A1 * 10/1997 ..... B21D 22/04
DE 102005026507 A1 12/2006
(Continued)

OTHER PUBLICATIONS

Translation, DE 19613180 A1; Oct. 1997.*
(Continued)

*Primary Examiner* — Edward T Tolan
(74) *Attorney, Agent, or Firm* — Birch, Stewart, Kolasch & Birch, LLP

(57) ABSTRACT

Provided are a protrusion forming device, a protrusion forming method, and a formed article, with which a height equal to or greater than the plate thickness is possible, the edges are sharp, and cracking can be prevented. This protrusion forming device is characterized by being equipped with a die unit provided with a die hole, and a punch unit having a large punch part with a size such that this part cannot be inserted into the die hole, and a small punch part that protrudes from the large punch part toward the die unit and can be inserted into the die hole, and characterized in that the workpiece is deformed by pressing a portion of the
(Continued)

workpiece arranged between the die unit and the punch unit toward the die unit by means of the punch unit, thereby forming a protrusion.

6 Claims, 10 Drawing Sheets

(51) Int. Cl.

| | |
|---|---|
| ***B21J 5/02*** | (2006.01) |
| ***B21K 23/00*** | (2006.01) |
| ***B21D 53/28*** | (2006.01) |
| ***B21D 28/16*** | (2006.01) |
| ***B21K 1/30*** | (2006.01) |
| ***B21D 28/26*** | (2006.01) |
| ***B21D 37/12*** | (2006.01) |

(52) U.S. Cl.
CPC ..... *B21D 37/12* (2013.01); *B21D 53/28* (2013.01); *B21J 5/02* (2013.01); *B21K 1/30* (2013.01); *B21K 23/00* (2013.01)

(58) Field of Classification Search
CPC ..... B21D 28/14; B21D 28/16; B21D 28/02; B21D 28/34; B21D 28/24; B21D 28/243; B21D 28/26; B21D 28/343; B21J 5/02; B21K 1/30
See application file for complete search history.

(56) References Cited

U.S. PATENT DOCUMENTS

| | | | | | |
|---|---|---|---|---|---|
| 2,814,863 | A * | 12/1957 | Nagel | B21C 23/01 | 72/332 |
| 3,656,394 | A * | 4/1972 | McCutcheon | B26F 1/14 | 83/689 |
| 3,731,369 | A * | 5/1973 | Johnson | B21D 39/032 | 29/509 |
| 4,604,495 | A * | 8/1986 | Watanabe | H01L 21/50 | 174/551 |
| 4,928,375 | A * | 5/1990 | Hadaway | B21D 22/04 | 29/509 |
| 5,502,994 | A * | 4/1996 | Katoh | B21C 23/183 | 29/874 |
| 5,934,135 | A * | 8/1999 | Webster | B21J 5/02 | 72/359 |
| 6,405,420 | B1 * | 6/2002 | Donhauser | B21J 15/025 | 29/243.519 |
| 2003/0061855 | A1 * | 4/2003 | Ushida | B21D 53/28 | 72/327 |
| 2004/0187551 | A1 * | 9/2004 | Iwabuchi | H01L 21/4842 | 72/412 |
| 2009/0165525 | A1 * | 7/2009 | Schlatter | B21D 28/16 | 72/333 |
| 2014/0331731 | A1 * | 11/2014 | Flehmig | B21D 24/16 | 72/327 |
| 2016/0114379 | A1 * | 4/2016 | Nishimura | B21D 24/04 | 72/352 |

FOREIGN PATENT DOCUMENTS

| | | | | | |
|---|---|---|---|---|---|
| DE | 10220009 | B4 | | 3/2011 | |
| JP | S55122927 | U | | 9/1980 | |
| JP | 62-238026 | A | * | 10/1987 | B21D 28/02 |
| JP | 02112845 | A | | 4/1990 | |
| JP | H10202329 | | | 8/1998 | |
| JP | 3339363 | B2 | | 10/2002 | |

OTHER PUBLICATIONS

Office Action issued in the CN Patent Application No. CN201680051174.8, dated Dec. 2, 2019.
SIPO Office Action corresponding to Application No. CN201680051174.8; dated Jun. 4, 2019.
International Search Report corresponding to Application No. PCT/JP2016/069332; dated Aug. 9, 2016.
Extended European Search Report corresponding to Application No. 16821299.1-1016/3320997 PCT/JP2016069332; dated Jan. 23, 2019.
Intellectual Property India Office Action for corresponding IN Application No. 201847003539 dated Feb. 24, 2020.

* cited by examiner

PROTRUSION MOLDING DEVICE, PROTRUSION MOLDING METHOD, AND MOLDED ARTICLE

The present U.S. patent application is a U.S. National Phase Application under 35 U.S.C. 371 of International Application PCT/JP2016/069332, filed on Jun. 29, 2016. Priority under 35 U.S.C. § 119(a) and 35 U.S.C. § 365(b) is claimed from Japanese Application No. 2016-124835, filed on Jun. 23, 2016, and Japanese Application No. 2015-135834, filed on Jul. 7, 2015, the entireties of both of which are incorporated herein by reference.

TECHNICAL FIELD

The present invention relates to a protrusion forming device, a protrusion forming method and a formed article.

BACKGROUND ART

Upon forming a protrusion in a sheet-like workpiece such as a steel sheet, in the case of the height of the protrusion being somewhat large compared to the sheet thickness, forming is carried out by drawing.

However, drawing requires the distance between a lateral face of a punch and an inner face of a die hole to be at least the sheet thickness. In addition, in the case of drawing, R (roundness) of the corners of the punch and die is large. For this reason, it has not been possible to form a protrusion having a sharp edge.

In the case of forming a protrusion having a sharp edge, forming has been performed by half blanking according to the fine blanking method.

The fine blanking method is a method of performing shearing with high precision by causing a compressive force to act on the workpiece, thereby causing plastic deformation.

However, with the fine blanking method, forming is difficult in the case of the height of the protrusion being the sheet thickness or greater. This is because, when the height of the protrusion is the sheet thickness or greater, due to the punch diameter and die hole diameter generally being approximately the same, it is not possible to process by the workpiece being sheared by the shearing force.

For this reason, technology has also been disclosed that pinches a workpiece by way of a punch and punch holder, while at the same time pushing a punch of smaller diameter than the die hole diameter into the workpiece, and causing the bottom face of the workpiece to enter into the die hole while forming a concave part, and performs half blanking using, cold forging dies that produce compressive deformation at this pinched part (refer to Patent Document 1).

Patent Document 1: Japanese Patent No. 3339363

DISCLOSURE OF THE INVENTION

Problems to be Solved by the Invention

However, with the above-mentioned conventional technology, the strength at a portions of the workpiece gripped by the punch and die hole not sufficient, and there is a possibility of cracking occurring in this portion.

An object of the present invention is to provide a protrusion forming device, protrusion forming method and formed article for which a height of at least the sheet thickness can be formed, the edges are sharp, and the occurrence of cracking is further prevented.

Means for Solving the Problems

The present invention is a protrusion forming device which includes: a die unit provided with a die hole; and a punch unit having a large punch part that can advance and retreat in a first direction towards the die unit, and is of a size incapable of insertion into the die hole, and a small punch part that projects from the large punch part to a side of the die unit, and is or a size capable of insertion into the die hole, in which the protrusion forming device causes a workpiece to deform by pressing a part of the workpiece arrange, between the die unit and the punch unit to a side of the die unit by way of the punch unit.

In the protrusion forming device, it is preferable for an interval d1 between a lateral face of the small punch part and a lateral face of the large punch part, and an interval d2 between a lateral face of the small punch part and an inner face of the die hole to be in a relationship of d2<d1.

In the protrusion forming device, it is preferable for an interval d2 between a lateral face of the small punch part and an inner face of the die hole, and a sheet thickness of the workpiece to be in a relationship of d2<T.

It preferable for a sloped face which inclines in a direction in which the thickness of the small punch part becomes thinner as approaching a rim part of the small punch part to be provided to a bottom face of the small punch part.

The present invention is a protrusion forming method including: a placement step of placing a workpiece on a die unit provided with a die hole; and a punching step of forming a protrusion by causing a punch unit, which has a large punch part of a size incapable of insertion into the die hole, and a small punch part that projects from the large punch part to a side of the die unit and is of a size capable of insertion into the die hole, to move in a first direction approaching the side of the die unit, and pressing a part of a workpiece arranged between the die unit and the punch unit to the side of the die unit by way of the punch unit so as to deform the workpiece.

In the protrusion forming method, it is preferable for an interval d1 between a lateral face of the small punch part and a lateral face of the large punch part, and an interval d2 between a lateral face of the small punch part and an inner face of the die hole to be in a relationship of d2<d1.

In the protrusion forming method, it is preferable for an interval d2 between a lateral face of the small punch part and an inner face of the die hole, and a sheet thickness T of the workpiece to be in a relationship of d2<T.

It the protrusion forming method, it is preferable for the punching step to include: a first step of forming a protrusion by way of a punch unit provided in which a sloped face that inclines in a direction in which a thickness of the small punch part becomes thinner as approaching a rim part of the small punch part provided to a bottom face of the small punch part; and a second step of forming a protrusion by way or a punch unit in which the bottom face of the small punch part is a level surface.

The present invention is also a formed article including: a flat part or thickness T; and a protrusion that projects from a side of one surface of the flat part, in which a first concave part having a first width S1, and a second concave part formed by further indenting from the first concave part and having a second width S2, are formed on a side of another surface of the protrusion of the formed article, and a thickness d2 of a side wall part of the second concave part, and the thickness of the flat part satisfy the relationship of d2<T.

The formed article can be formed such that H≥T when defining a height H as a height from the one surface of the flat part until a top face of the side of the one surface of the protrusion.

Furthermore, in the formed article, it is preferable for a width S1 of the first concave part, width S2 of the second concave part, and width S3 of the protrusion at the side of the one surface to satisfy the relationship of S2<S3<S1.

Effects of the Invention

It possible to provide a protrusion forming device, protrusion forming method and formed article for which a height of at least the sheet thickness can be formed, the edges are sharp, and the occurrence or cracking is further prevented.

PREFERRED MODE FOR CARRYING OUT THE INVENTION

First Embodiment

Figure 1A:
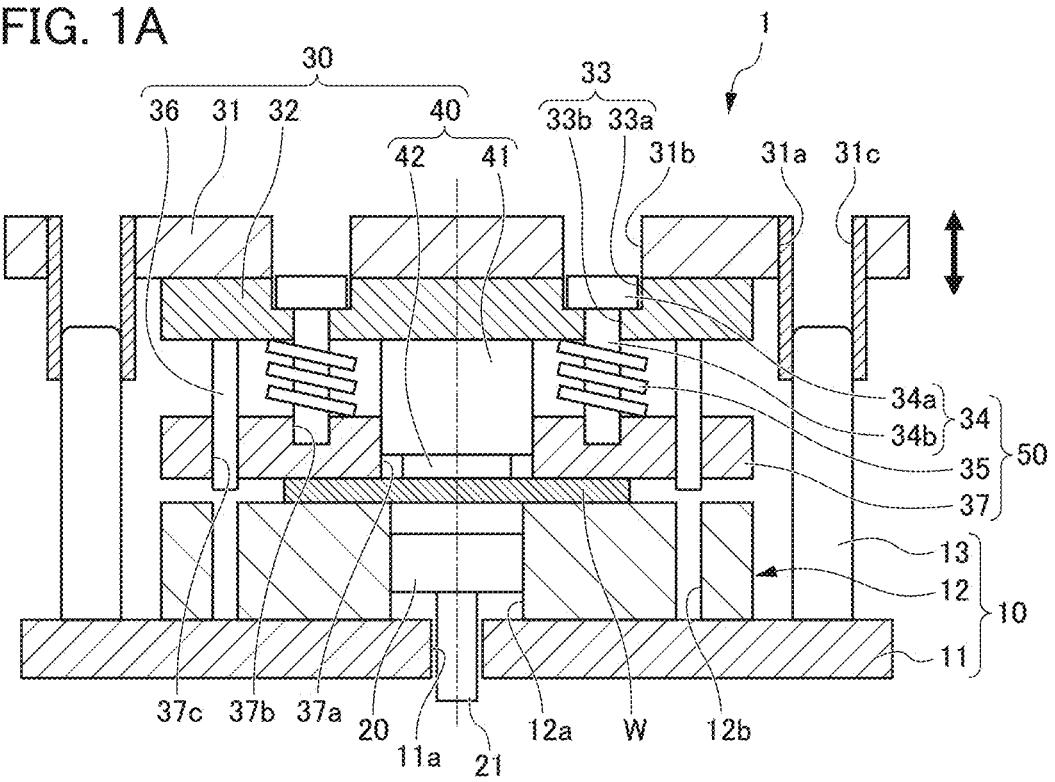
FIG. 1A is a schematic drawing of a protrusion forming device showing prior to processing of a workpiece.

Hereinafter, the overall configuration a protrusion forming device 1 of an embodiment of the present invention will be explained based on the drawings. The protrusion forming device 1 is a device that forms a protrusion in a sheet-like workpiece W such as a steel sheet, with FIG. 1A showing a state prior to forming of a protrusion W1 arranging the workpiece W in the protrusion forming device 1, and FIG. 1B being a schematic drawing showing a state of forming the protrusion W1 in the workpiece W1 arranged in the protrusion forming device 1.

Figure 2A:
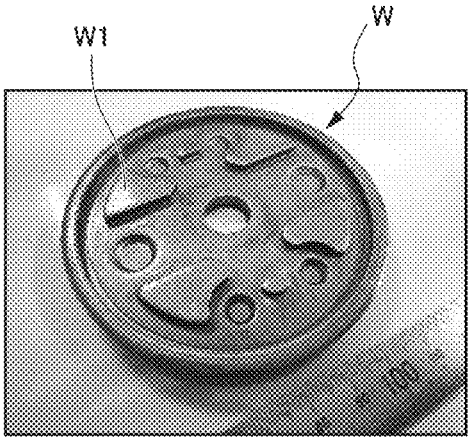
FIG. 2A is a photograph viewing from below a sheet gear in which a downward protrusion W1 is provided.
Figure 2B:
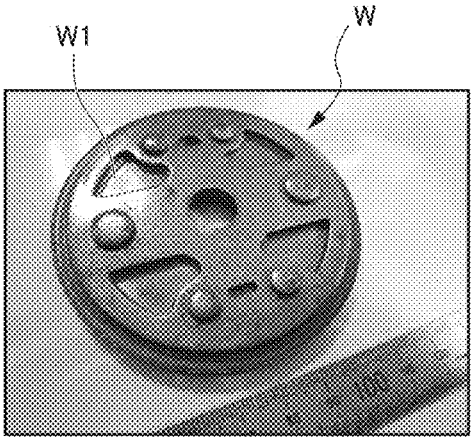
FIG. 2B is a photograph viewing from above a sheet gear in which a downward protrusion W1 is provided.

The protrusion forming device of the present embodiment is a device used upon forming a protrusion W1 in a sheet gear such as that shown in FIG. 2, for example. FIG. 2A is a photograph viewing from below a sheet gear in which a downward protrusion W1 is provided, and FIG. 2B is a photograph viewing from above a sheet gear in which the downward protrusion W1 is provided. In the case of a sheet gear, in order to improve the efficiency of the rotary torque, it is preferable for the surface area on a side contacting with die hole 12*a* of the protrusion W1 to be larger.

It should be noted that a case of forming a state in which the protrusion W1 projects downwards as shown in FIG. 2B will be explained in the following explanation.

The protrusion forming device 1 includes a fixed part 10, a moving part 30 that moves vertically relative to the fixed part 10, and a pressing part 50 that is retained by the moving part 30, and further moves relative to the moving part 30. It should be noted that vertical is the direction of the arrows shown in FIG. 1, and hereinafter in the present disclosure, the direction in which the moving part 30 approaches the fixed part 10 is referred to as down (first direction), and the direction in which the moving part 30 distances from the fixed part 10 is referred to as up.

The fixed part 10 includes a die holder 11, die unit 12, and guide posts 13.

The die holder 11 is produced from a substantially rectangular thick-plate member. It should be noted that the shape of the die holder 11 is not limited to a rectangle. A through-hole 11*a* is provided in the central part of the die holder 11.

The guide posts 13 extend from the outer circumferential part of the die holder 11 towards up in the drawings. Four of the guide posts 13 (only two shown in drawings) are provided in the present embodiment, for example.

The die unit 12 is arranged more inwards than the guide posts 13 on the top face of the die holder 11, and is fixed to the die holder 11. The die unit 12 is a metallic member of constant thickness, and a die hole 12*a* corresponding to the shape of the protrusion W1 formed by the protrusion forming device 1 is provided in the central part thereof.

In addition, at the outer side of the die hole 12*a* of the die part 12, a plurality of the guide holes 12*b* is provided.

Inside of the die hole 12*a*, a lower die 20 which is substantially the same shape and same size as the die hole 12*a*, and decides the height of the protrusion W1, is arranged.

The upper end of a rod-shaped knockout member 21 for discharge of the workpiece W is mounted to the bottom face of the lower die 20. The lower end of the knockout member 21 extends downwards from the aforementioned through-hole 11*a* provided in the die holder 11, and is joined to a drive mechanism that is not illustrated. The drive mechanism presses the lower die 20 upwards via the knockout member 21.

The moving part 30 includes a punch holder 31, backing plate 32, guide pin 36, and punch unit 40.

The punch holder 31 is produced from a thick-plate member of substantially the same size as the die hold 11.

At an outer circumferential part of the punch holder 31, a first through-hole 31*a* is provided at a position corresponding to the aforementioned guide post 13. A guide bushing 31*c* is inserted and fixed to the first through-hole 31*a*. The guide bushing 31*c* is a cylindrical member, and extends to below the punch holder 31. The guide post 13 is inserted inside of the guide bushing 31*c*, and stable vertical motion of the moving part 30 relative to the fixed part 10 is ensured by the guide bushing 31*c* moving along the outer circumference of the guide post 13.

More to the inner side than the guide bushing 31*c* in the punch holder 31, a plurality of second through-holes 31*b* is provided.

The backing plate 32 is mounted more to the inner side than the posit on at which the guide bushing 31*c* is provided at the bottom face of the punch holder 31.

At a position corresponding to the aforementioned second through-hole 31*b* in the backing plate 32, a two-stage hole 33 continuing from the second through-hole 31*b* is provided.

The two-stage hole 33 includes a first hole 33*a* having the same axis line as the second through-hole 31*b*, continues from the second through-hole 31*b*, and of the same diameter as the second through-hole 31*b*; and a second hole 33*b* having the same axis line as the second through-bole 31*b*, provided further downwards than the first hole 33*a*, and of a smaller diameter than the first hole 33*a*.

The guide pin 36 is mounted to the bottom face of the backing plate 32 more to the outer circumferential side than the two-stage hole 33, and extends toward below the backing plate 32.

The punch unit 40 is fixed to the bottom face of the backing plate 32 at a central part thereof.

Although described in detail later, the punch unit 40 includes a large punch part 41 on the side of the backing plate 32, and a small punch part 42 on the side of the workpiece W.

The pressing part 50 includes a bolt member 34, presser plate 37, and coil spring 35.

The bolt member 34 has a head part 34*a* that is smaller than the diameters of second through-hole 31 and first hole 33*a*, and larger than the diameter of the second hole 33*b*, and an extending part 34*b* having smaller diameter than the diameter of the second hole 33*b*.

The bolt member 34, with the head part 34*a* up, has the extending part 34*b* inserted inside of the second through-hole 31*b*, first hole 3*a* and second hole 33*b*, and is screw clamped to the presser plate 37.

The coil spring 35 is arranged at a portion of the bolt member 34 which projects from the backing plate 32 (bolt member 34 is inserted into the coil spring 35).

The presser plate 37 is arranged at the outer circumferential side of the punch unit 40. The presser plate 37 is a thick-plate member, in which a first opening 37*a* is formed in the central part thereof, and this first opening 37*a* is substantially the same diameter as the large punch part 41 of the punch unit 40, and the large punch part 41 can slide within the first opening 37*a*.

At an outer circumferential side of the first opening 37*a* on the top face of the presser plate 37, a bottomed threaded part 37*b* for bolt fixing provided. The threaded part 37*b* is provided at a position corresponding to the extending part 34*b* of the aforementioned bolt member 34, and a front end of the extending part 34*b* is inserted and fixed to this threaded part 37*b*.

The coil spring 35 is arranged between the backing plate 32 and presser plate 37 on the outer circumference of the extending part 34*b*.

In addition, at position corresponding to the aforementioned guide pin 36 on the outer circumferential side of the first opening 37*a* on the presser plate 37, a second opening 37*c* is provided. The guide pin 36 is inserted into the second opening 37*c*. The lower end of the guide pin 36 is further inserted into the guide hole 12*b* of the die unit 12, and the guide pin 36 is guided straight ahead by the guide hole 12*b* in the die unit 12 and the second opening 37*c*.

The workpiece W is arranged on the die unit 12. The workpiece W is a hot-rolled steel sheet (SPFH590) for automobiles, for example.

In the case of forming a protrusion in the workpiece W, the workpiece W is arranged on the die unit 12. At this time, the protrusion forming location on the workpiece N is aligned so as to position on the die hole 12*a*.

It should be noted that, at this moment, the moving part 30 of the protrusion forming device 1 is positioned more upwards than the state in FIG. 1A.

Next, the moving part 30 is made to descend by the drive mechanism (not illustrated), whereby the presser plate 37 is made to abut the workpiece W.

Then, the moving part 30 is made to descend, and the bottom face of the small punch part 42 of the punch unit 40 is then made to abut the workpiece N as shown in FIG. 1A.

Next, the moving part 30 is further pressed downwards by the drive mechanism. The punch unit 40 thereby further descends, and presses the workpiece W by the small punch part 42 and large punch part 41.

Figure 1B:
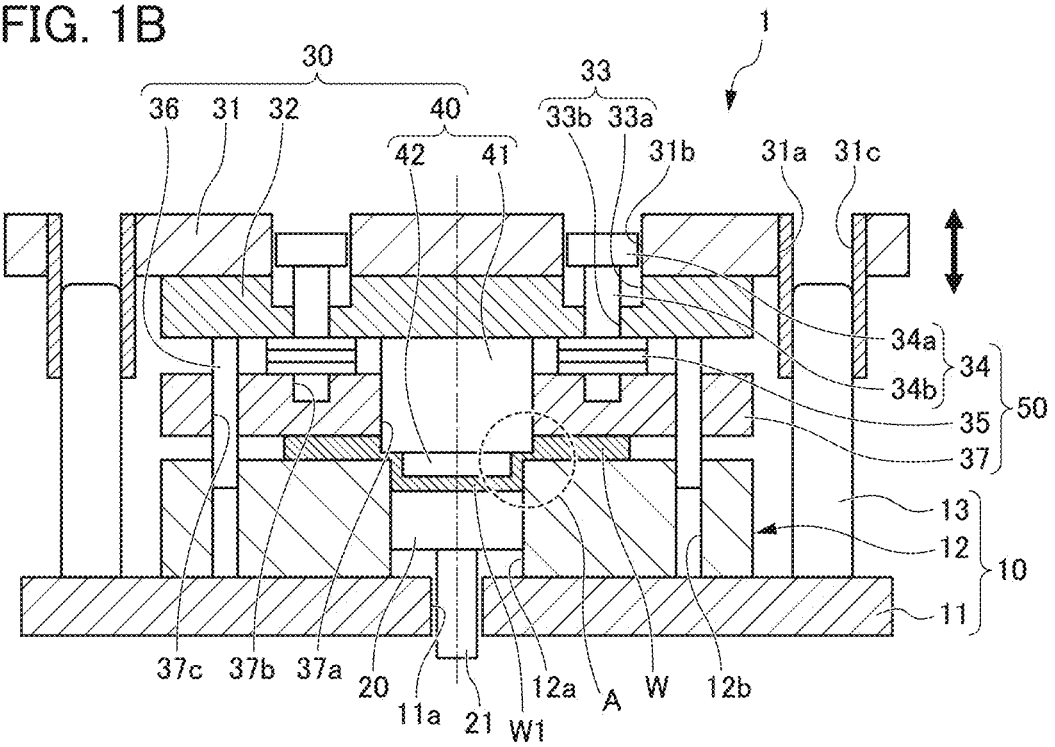
FIG. 1B is a schematic drawing of a protrusion forming device showing after processing of the workpiece.

Plastic deformation occurs in the workpiece W, and a protrusion W1 of a desired shape is formed as shown in FIG. 1B.

Subsequently, the moving part 30 is made to ascend, whereby the small punch part 42 and large punch part 41 are made to distance from the work-piece W, and the lower die 20 is pushed up by the knockout member 21.

When done in this way, the protrusion W1 of the workpiece W is pushed out from the die hole 12*a*, and removal of the workpiece W becomes possible.

Figure 3:
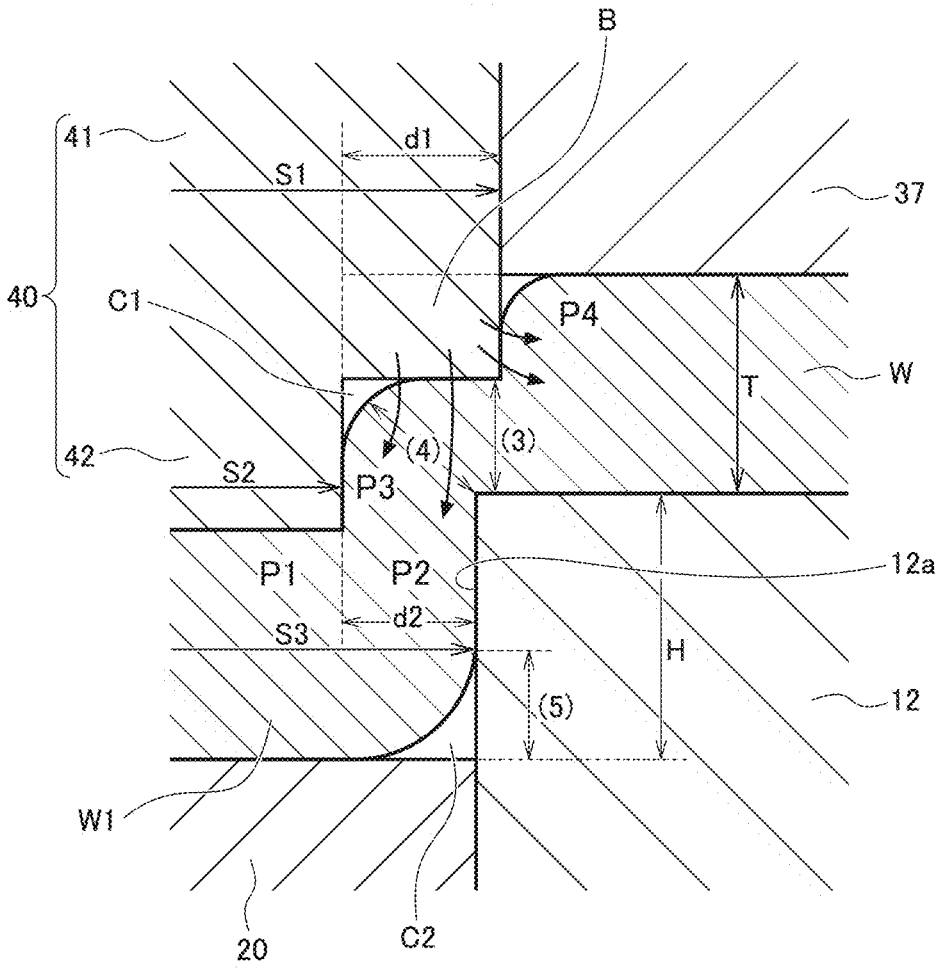
FIG. 3 is an enlarged view of the part A in FIG. 1B.
Figure 4:
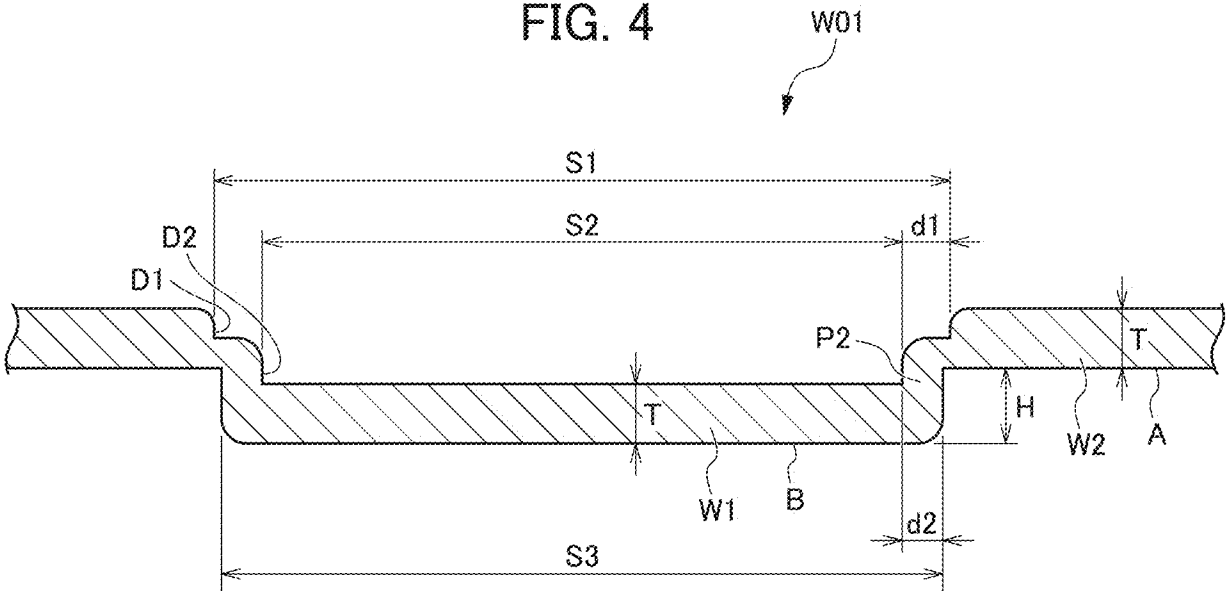
FIG. 4 is a partial cross-sectional view of a formed article W01 after processing.

FIG. 3 is an enlarged view of the part A in FIG. 1B, after forming of the protrusion W1. FIG. 4 is a partial cross-sectional view of the formed article W01 after forming of the protrusion W1.

In the present embodiment, when defining the interval between the lateral face of the small punch part 42 and lateral face of the large punch part 41 as d1, and defining the interval between the lateral face of the small punch part 42 and inner face of the die hole 12*a* as d2, there is the relationship of $$d2<d1 \quad (1),$$

as shown in FIG. 3.

In other words, in a predetermined cross section, a width S1 of the large punch part 41, a width S2 of the small punch part 42, and a width S3 of the die hole 12*a* have the relationship of $$S2<S3<S1 \quad (2).$$

Since (S1−S2)/2 (S3−S2)/2=d2, and S3<S1 according to Formula), it becomes d2<d1 in the above Formula (1).

In addition, in the present embodiment, the interval d2 between the lateral face of the small punch part 42 and inner face of the die hole 12*a* when inserted into the die hole 12*a* is less than the sheet thickness T of the workpiece W.

$$T>d2 \quad (3)$$

In addition, as shown in FIG. 4, when viewing as the formed article W01, the formed article W01 includes a flat part W2 of thickness T, the protrusion W1 of thickness T projecting to the lower side in FIG. 4 from the side of one surface A of the flat part W2, and a rising part P2 which rises up from the flat part W2 to the protrusion W1.

The interval d2 between the lateral face of the small punch part 42 and inner face of the die hole 12*a* when inserted into the die hole 12*a* is also referred to as the thickness d2 of the rising part P2 in a direction orthogonal to the thickness T direction of the flat part W2, and satisfies the relationship of $$T>d2 \quad (3),$$

as mentioned above.

In addition, relative to the sheet thickness T of the workpiece W, the height H from the one surface A of the flat part W2 until one surface B of the protrusion W1 can satisfy the relationship of $$H \geq T \quad (4).$$

Furthermore, a portion of the protrusion W1 on the opposite side of a surface B is pressed by the punch unit 40, and thus becomes a concave part. The concave part has a first concave part D1 having a first width S1 that is roughly the same as the width S1 of the large punch part 41, and a second concave part D2 that is formed by further indenting from the first concave part D1, and has a second width S2 that is roughly the same as the width S2 of the small punch part 42. Then, the width of the protrusion W1 on the side of the surface B is equal to the width S3 of the die hole 12*a*, and satisfies the relationship of $$S2 < S3 < S1 \quad (2),$$

as mentioned above.

Figure 5A:
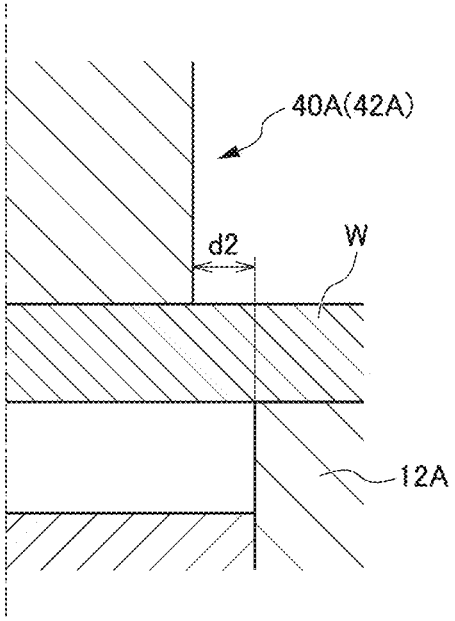
FIG. 5A shows a comparative embodiment showing a state of arranging the workpiece on the die.

Next, for ease of understanding the effects of the present embodiment, first, comparative embodiment will be explained. FIG. 5 is a view showing a comparative embodiment. FIG. 5A shows a state arranging the workpiece W on the die unit 12A of the comparative embodiment FIG. 5B shows a state forming the protrusion W1 in the workpiece W by causing a punch unit 40A of the comparative embodiment to descend.

The punch unit 40A of the comparative embodiment does not have the large punch part as shown in the illustration, and only has a small punch 42A.

It should be noted that the interval d2 between the lateral face of the small punch part 42 and inner face of the die hole 12*a* in the comparative embodiment is no more than the sheet thickness T of the workpiece W.

Figure 5B:
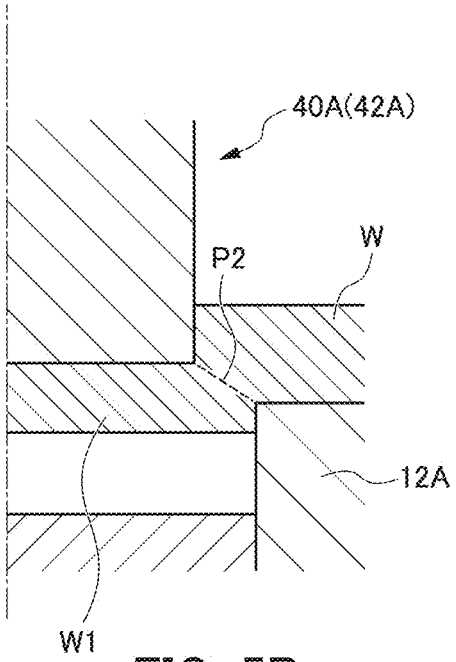
FIG. 5B shows a comparative embodiment showing a state of forming a protrusion on the workpiece by causing the punch to descend.

In the comparative embodiment, when causing the punch unit 40A to descend from the state of FIG. 5A, the punch unit 40A (small punch 42A) presses the workpiece W as shown in FIG. 5B.

If the indentation depth becomes deeper, the workpiece W will plastically deform. Herein, since the workpiece W deformed due to shearing, the edge of the protrusion will be sharp. However, cracks form due to the tensile stress acting on the rising part (portion of P2 illustrated) of the protrusion.

However, the punch unit 40 of the present embodiment is a two-stage structure of the large punch part 41 and small punch part 42, as shown in FIG. 3.

According to the present embodiment, the portion of the workpiece W that existed in the portion indicated by reference symbol B in FIG. 3 is pressed downwards by the large punch part 41 upon forming the protrusion W1. When this is done, the material of this part B flows to other portions as shown by the arrows in FIG. 3. In other words, the material is pressed and flows, whereby material supply is performed to portions on which tensile force acts, and the tensile force is alleviated. In addition, by being pressed by the large punch part 41, this pressed portion is forged and the hardness increases.

Figure 6:
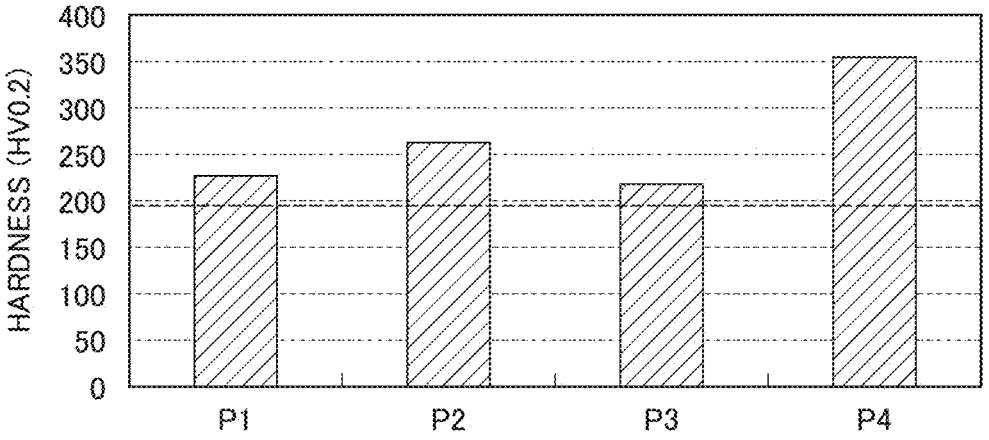
FIG. 6 is a graph showing the results of measuring the hardness of portions P1 to P4 in FIG. 3 of the protrusion formed in the present embodiment.

FIG. 6 is a graph showing the results or measuring the hardness of portions P1 to P4 in FIG. 3 of the workpiece W formed in the present embodiment.

In FIG. 6, the position indicated by the dotted line is the hardness 197 HV of the workpiece W itself. According to the present embodiment, it is hardened at all or portions P1 to P4, and thus an improvement in product strength is also possible.

Furthermore, in the present embodiment, R at the corner of the workpiece W after forming becomes sharp (corner sag hardly occurs), due to the protrusion W1 also having a deformed shape due to shear. Therefore, it is possible to form detailed concavities and convexities.

In addition, the material having flowed from the portion B not only causes the hardness to rise, by flows to other portions of the workpiece W. Due to this flow, it is possible to ensure a predetermined thickness at the portions of P2 and P3, which are the rising parts of the protrusion W1. In addition, this flowed material is pushed into the corner C1 between the large punch part 41 and small punch part 42 of the workpiece W, and the corner C2 between the lower die 20 and lateral side of the die hole 12*a*; therefore, R at the corner of the workpiece after formed becomes sharper (corner sag hardly occurs). Therefore, it is possible to form more detailed concavities and convexities.

Then, according to the present embodiment, since the edge of the protrusion W1 becomes sharp in this way, the surface area of the portion of the protrusion W1 contacting with the die hole 12*a* becomes larger. For this reason, in the case of causing the protrusion W1 to contact another member to cause the workpiece a to rotate, it is possible to produce a large rotary torque.

Therefore, it is suited to the production or protrusions such as sheet gears.

Second Embodiment

Figure 7:
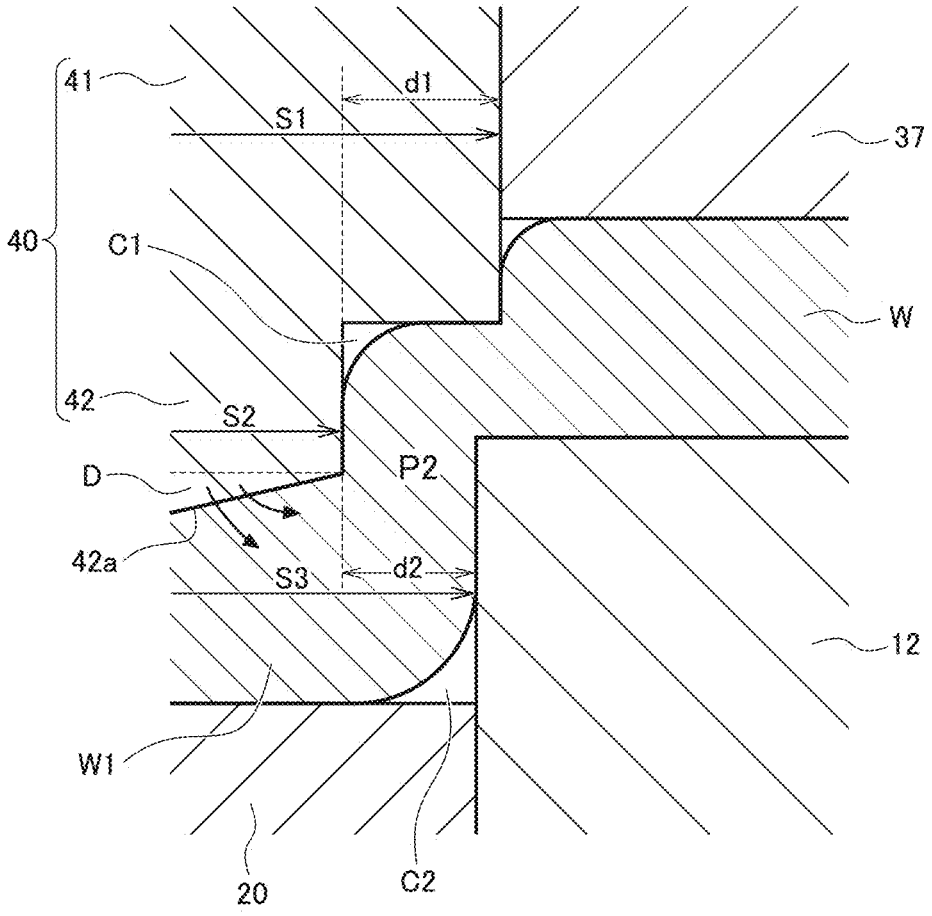
FIG. 7 is a view showing a second embodiment of the present invention, corresponding to FIG. 3 of the first embodiment.
Figure 8:
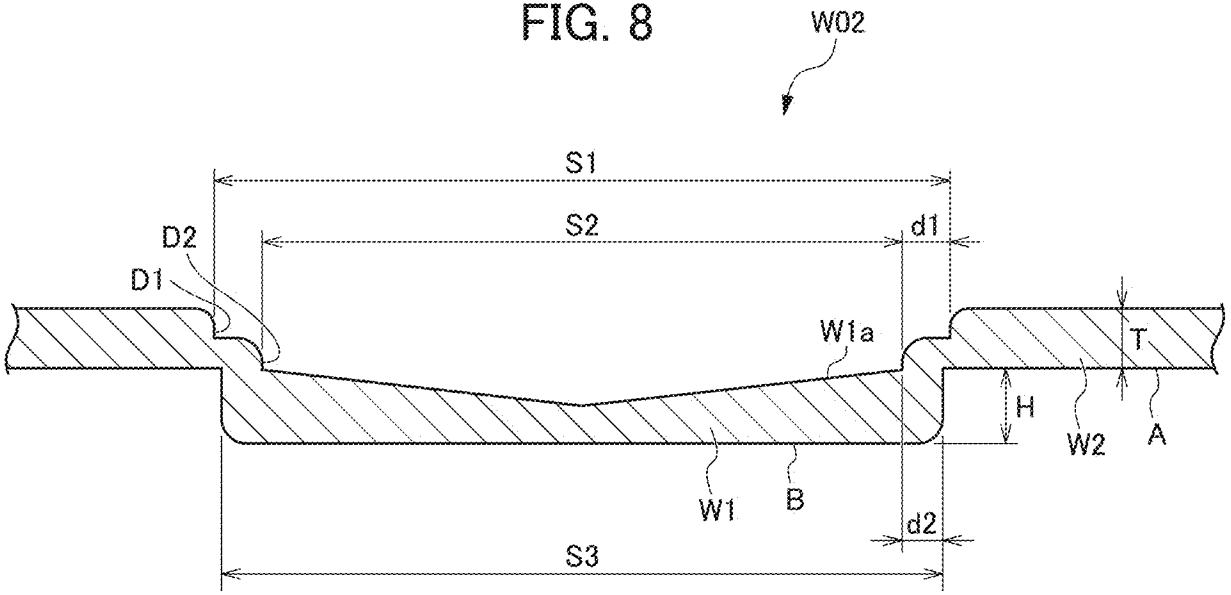
FIG. 8 is a partial cross-sectional view of a formed article W02 after processing.

FIG. 7 is a view showing a second embodiment of the present invention, and corresponds to FIG. 3 of the first embodiment. FIG. 8 is a partial cross-sectional view of a formed article W02 after processing according to the second embodiment.

A point by which the present embodiment differs from the first embodiment is the point of a sloped face 42*a* which inclines in a direction in which the thickness of the small punch part 42 becomes thinner as approaching the rim part of the small punch part 42 is provided to the bottom face of the small punch part 42.

In addition, what the formed article W02 of the second embodiment differs from the formed article W01 of the first embodiment is in the point of a sloped face W1*a* being formed at the bottom of a second concave art D2 by the sloped face 42*a* of the small punch part 42. Since other portions are similar, explanations thereof will be omitted.

According to the present embodiment, upon pressing the punch unit 40 to the surface of the workpiece W, since the sloped face 42*a* is provided, the material that existed at the part D of the workpiece W at which the sloped face 42*a* is positioned tends to flow in the directions indicated by the arrows in the drawing.

Therefore, the flow of material to the portion P2 between the small punch part 42 and die hole 12*a* at which cracking tends to occur further promoted. It is thereby possible to form the protrusion W1 in which it is more difficult for cracks (cracking) to occur than in the first embodiment.

In addition, the flowed material flows to other portions of the workpiece W. This flowed material is pushed into the corner C1 between the large punch part 41 and small punch part 42 of the workpiece W, and corner C2 between the lower die 20 and lateral face of the die hole 12*a*, whereby R of the corner of the workpiece W after forming (formed article W02) becomes even sharper. Therefore, it is possible to form more detailed concavities and convexities.

Then, according to the present embodiment, since the edge of the protrusion W1 becomes sharp in this the surface area of the port on of the protrusion W1 contacting with the die hole 12*a* becomes larger. For this reason, in the case of causing the protrusion W1 to contact another member to cause the workpiece a to rotate, it possible to produce a larger rotary torque.

Third Embodiment

A third embodiment a method of forming the protrusion W1 in the workpiece W by the protrusion forming device 1 of the second embodiment shown in FIG. 7, and then further forming the protrusion W1 more sharply by further pressing the workpiece W, by the protrusion forming device 1 of the first embodiment shown in FIG. 3.

According to the present embodiment, first, upon pushing the punch unit 40 to the surface of the workpiece W by way of the protrusion forming device of FIG. 7, the material of the surface of the workpiece W is made to flow to the outer side of the small punch part 42 by way of the sloped face 42*a*.

Next, it is possible to make the edge part more sharply, by causing the material in the portion of FIG. 7 to further flow by the protrusion forming device of FIG. 3.

Fourth Embodiment

Figure 9:
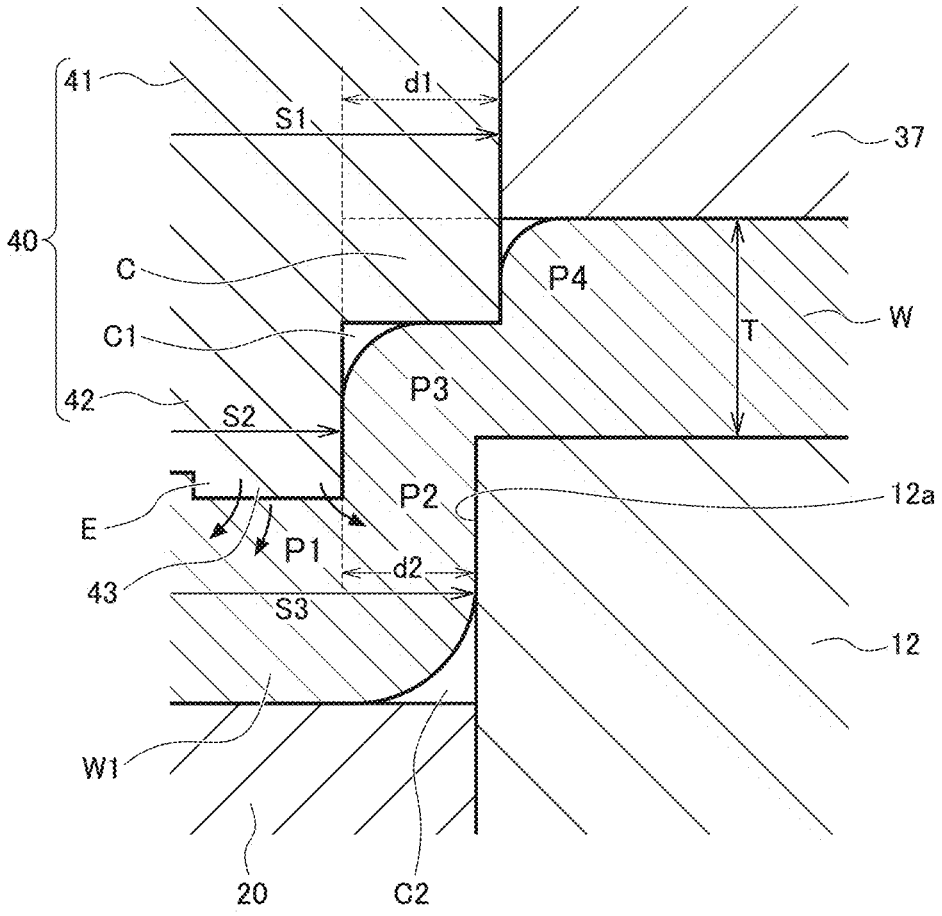
FIG. 9 is a view showing a fourth embodiment of the present invention, corresponding to FIG. 3 of the first embodiment.
Figure 10:
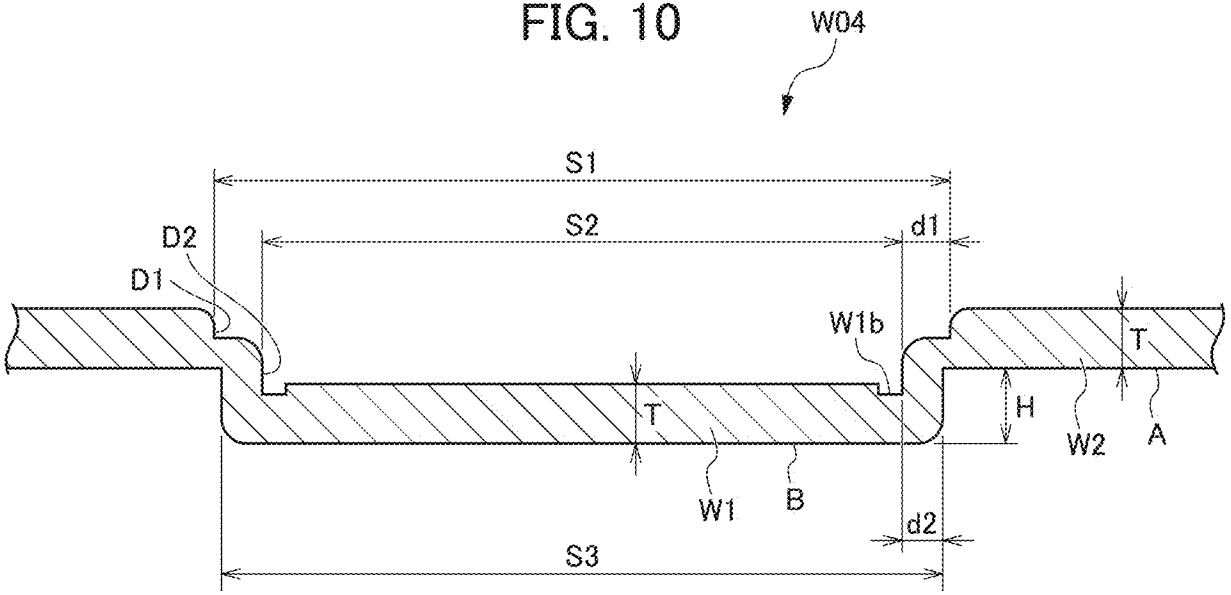
FIG. 10 is a partial cross-sectional view of a formed article W04 after processing.

FIG. 9 is a view showing a fourth embodiment of the present invention, and corresponds to FIG. 3 of the first embodiment. FIG. 10 is a partial cross-sectional view of a formed article W04 after processing in the fourth embodiment.

The point whereby the punch unit 40 of the protrusion forming device 1 of the present embodiment differs from the first embodiment is the point in which a projection 43 along the outer circumference of the small punch part 42 is provided at an end of an surface of the small punch part 42 on the side of the workpiece W.

Then, what the formed article W04 of the fourth embodiment differs from the formed article W01 of the first embodiment is in the point of a concave part W1*b* being further formed at the corner of the bottom of a second concave part P2 by the projection 43, as shown in FIG. 10. Since other portions are similar, explanations thereof will be omitted.

According to the present embodiment, since the projection 43 is being provided, it is possible to reduce the pressing weight more than pressing by the entirety of the bottom face of the punch unit 40 during forming.

In addition, according to the present embodiment, upon pushing the punch unit 40 against the surface of the workpiece W, the material that existed at part E of the workpiece W at which the projection 43 is positioned tends to flow in the directions indicated by the arrows in the drawing, due to the projection 43 being provided.

Therefore, the flow of material to the portion of P2 between the small punch part 42 and inner face of the die hole 12*a* at which cracking tends to occur is further promoted. It is thereby possible to form the protrusion W1 in which it is more difficult for cracks (cracking) to occur than in the first embodiment.

In addition, the flowed material not only causes the hardness to rise, but also flows to other portions of the workpiece W. This flowed material is pushed into the corner C1 between the large punch part 41 and small punch part 42 of the workpiece W, and the corner C1 between the lower die 20 and the lateral face of the die hole 12*a*, whereby R of the corner of the workpiece W after forming becomes even sharper. Therefore, it is possible to form more detailed concavities and convexities.

Then, according to the present embodiment, since the edge of the protrusion W1 becomes sharp in this way, the surface area of the portion of the protrusion W1 contacting with the die hole 12*a* becomes larger. For this reason, in the case of causing the protrusion W1 to contact another member to cause the workpiece W to rotate, it is possible to produce a large rotary torque.

EXAMPLES

Hereinafter, the results of forming the protrusion W1 in the workpiece W using the devices of the aforementioned embodiments will be explained.

A load was applied using a knuckle press machine capable of applying a maximum load of 400 tons is the protrusion forming device 1.

The workpiece W was SPFH590, which is hot rolled sheet steel, and the mechanical properties used YS (yield stress) 522 MPa, TS (tensile strength) 604 MPa, EL (elongation) 26%, and two types of sheet thickness of 2.9 mm and 2.5 mm.

Hereinafter, the measured values of the protrusion W1 of the workpiece W formed using the protrusion forming device 1 of each embodiment are shown in Table 1.

FIG. 3 shows at which portions each of (1) protrusion height (H), (2) width-direction remaining sheet thickness (interval d2 between lateral face of small punch part and inner face of die hole), (3) sheet thickness-direction remaining sheet thickness, (4) 45° direction remaining sheet thickness, and (5) corner sag are.

TABLE 1

| | Sheet thickness T (mm) | (1) Protrusion height H (mm) | (2) Width-direction remaining sheet thickness d2 (mm) | (3) Sheet thickness-direction remaining sheet thickness (mm) | (4) 45° direction remaining sheet thickness (mm) | (5) Corner sag (mm) |
|---|---|---|---|---|---|---|
| First | 2.9 | 3.38 | 1.59 | 1.60 | 1.85 | 1.21 |
| embodiment | 2.5 | 3.34 | 1.59 | 1.50 | 1.62 | 1.61 |
| Second | 2.9 | 3.45 | 1.56 | 1.87 | 1.76 | 1.55 |
| embodiment | 2.5 | 3.44 | 1.56 | 1.80 | 1.51 | 1.92 |
| Third | 2.9 | 3.38 | 1.59 | 1.60 | 1.96 | 0.72 |
| embodiment | 2.5 | 3.34 | 1.59 | 1.50 | 1.74 | 0.90 |

Above, in the first embodiment, second embodiment, third embodiment and fourth embodiment, it was possible to form a protrusion W1 for which (1) protrusion height H is at least the sheet thickness T (H≥T) indicated by Formula (4), for both the cases of the sheet thickness of the workpiece W being 2.9 mm and 2.5 mm.

In addition, in the first embodiment, second embodiment, third embodiment and fourth embodiment, it was possible to form the protrusion W1 in a state in which a predetermined thickness was ensured in the range of no more than the sheet thickness T of the workpiece W, at (2) width-direction remaining sheet thickness d2, (3) sheet-thickness direction remaining sheet thickness and 45° direction remaining sheet thickness, for both the cases of the sheet thickness of the workpiece W being 2.9 mm and 2.5 mm.

Furthermore, after forming the protrusion W1 based on the second embodiment, the third embodiment having further formed the protrusion W1 based on the first embodiment could form a sharper protrusion W1 having less corner sag.

In addition, with the fourth embodiment providing the projection 43 to the end on the surface of the small punch part 42 on the side of the workpiece W, it was possible to form a sharp protrusion W1 having less corner sag than the first embodiment and second embodiment.

EXPLANATION OF REFERENCE NUMERALS

1 protrusion forming device
10 fixed part
11 die holder
12 die unit
12*a* die hole
30 moving part
31 punch holder
32 backing plate
36 guide pin
37 presser plate
40 punch unit
41 large punch part
42 small punch part
42*a* sloped face
43 projection

The invention claimed is:

1. A protrusion forming device comprising:
a die unit provided with a die hole; and
a punch unit having
a large punch part that can advance and retreat in a first direction towards the die unit, and is of a size incapable of insertion into the die hole, the large punch part having a constant width S1 in a predetermined cross section,
a small punch part that projects from the large punch part to a side of the die unit, and is of a size capable of insertion into the die hole, the small punch part having, in the predetermined cross section, a constant width S2 smaller than the constant width S1; and
a projection that projects from an edge along an outer circumference of a surface of the small punch part facing a workpiece, toward the workpiece, the projection having, in the predetermined cross section, an outer contour and an inner contour that are parallel to each other, and a constant thickness in the direction of the constant width S2, wherein
the protrusion forming device causes the workpiece to deform by pressing the workpiece arranged between the die unit and the punch unit to a side of the die unit by way of the punch unit, the pressing being performed by bringing the workpiece into contact sequentially with
a surface of the projection facing the workpiece,
a portion of the surface of the small punch part facing the workpiece, the portion being surrounded by the projection, and
a surface of the large punch part facing the workpiece,
so that the workpiece is formed into an article including a flat part having a thickness T, a protrusion having the thickness T and projecting from one surface of the flat part, and a rising part rising up from the flat part to the protrusion.

2. The protrusion forming device according to claim 1, wherein
an interval d1 between a lateral face of the small punch part and a lateral face of the large punch part, and
an interval d2 between a lateral face of the small punch part and an inner face of the die hole are in a relationship of $$d2<d1.$$

3. The protrusion forming device according to claim 1, wherein
an interval d2 between a lateral face of the small punch part and an inner face of the die hole, and
a sheet thickness T of the workpiece are in a relationship of $$d2<T.$$

4. A protrusion forming method comprising:
placing a workpiece on a die unit provided with a die hole; and
forming a protrusion by causing a punch unit, which has a large punch part of a size incapable of insertion into the die hole, the large punch part having a constant width S1 in a predetermined cross section, and a small punch part that projects from the large punch part to a side of the die unit and is of a size capable of insertion into the die hole, the small punch part having, in the predetermined cross section, a constant width S2 smaller than the constant width S1;
forming a projection that projects from an edge along an outer circumference of a surface of the small punch part facing a workpiece, toward the workpiece, the projection having, in the predetermined cross section, an outer contour and an inner contour that are parallel to each other, and a constant thickness in the direction of the constant width S2, to move in a first direction approaching the side of the die unit so as to deform the workpiece by pressing the workpiece arranged between the die unit and the punch unit to a side of the die unit by way of the punch unit, the pressing being performed by bringing the workpiece into contact sequentially with
a surface of the projection facing the workpiece,
a portion the surface of the small punch part facing the workpiece, the portion being surrounded by the projection, and
a surface of the large punch part facing the workpiece, and
forming an article including a flat part having a thickness T, a protrusion having the thickness T and projecting from one surface of the flat part, and a rising part rising up from the flat part to the protrusion.

5. The protrusion forming method according to claim 4, wherein an interval d1 between a lateral face of the small punch part and a lateral face of the large punch part, and
an interval d2 between a lateral face of the small punch part and an inner face of the die hole are in a relationship of $$d2<d1.$$

6. The protrusion forming method according to claim 4, wherein an interval d2 between a lateral face of the small punch part and an inner face of the die hole, and
a sheet thickness T of the workpiece are in a relationship of $$d2<T.$$

* * * * *